United States Patent [19]

Kupperman et al.

[11] 3,999,752

[45] Dec. 28, 1976

[54] PUSH-PULL TYPE OF EXERCISING DEVICE SUPPORTED ENTIRELY BY THE BODY

[75] Inventors: Sam Kupperman, Chicago; Dennis I. Kupperman, Glenview, both of Ill.

[73] Assignee: R B Toy Development Co., Skokie, Ill.

[22] Filed: Oct. 28, 1975

[21] Appl. No.: 626,294

[52] U.S. Cl. ..... 272/126; 272/DIG. 4; 273/DIG. 19; 272/143

[51] Int. Cl.[2] ..... A63B 23/00

[58] Field of Search ..... 272/126, 119, 116, 139, 272/143, 142, 94, 96, DIG. 4; 273/DIG. 19

[56] References Cited

UNITED STATES PATENTS

| | | | |
|---|---|---|---|
| 3,162,441 | 12/1964 | Karlik | 272/139 X |
| 3,677,543 | 7/1972 | Richardson | 272/136 |

FOREIGN PATENTS OR APPLICATIONS

| | | | |
|---|---|---|---|
| 1,478,048 | 11/1965 | Germany | 272/136 |
| 302,318 | 12/1929 | United Kingdom | 272/136 |

*Primary Examiner*—Richard C. Pinkham
*Assistant Examiner*—William R. Browne
*Attorney, Agent, or Firm*—Max R. Kraus

[57] ABSTRACT

A push-pull type of exercising device comprising a belt securable to the waist or midsection of a person. The belt supports a pair of pulleys, with each pulley supporting a flexible cord. One of the cords has its opposite ends looped and attached to a member connected to the cord to form adjustable hand grips. The other cord has its opposite ends looped and attached to a member connected to said other cord to form adjustable foot stirrups. Only a single pair of pulleys is connected directly to the belt. Said pulleys are attached to the belt at substantially the same location.

11 Claims, 9 Drawing Figures

12
14
16
18
20
21
22
24
26
28
30
31
32
33
34
35
36
38
40
42
44
46
47
48
52
53
54
56
58
60
62
64
66
66a

PUSH-PULL TYPE OF EXERCISING DEVICE SUPPORTED ENTIRELY BY THE BODY

BRIEF SUMMARY OF THE INVENTION

There are prior push-pull exercising devices, such as, for example, shown in U.S. Pat. No. 3,858,874, in which the exercising device is adapted to be secured to a fixed support, such as a door knob and/or the like. To use such an exercising device, it is essential that there be a fixed point to which the exercising device can be connected.

One of the objects of this invention is to eliminate the need for connecting the exercising device to any fixed member and to provide, if effect, a self-contained unit whereby a belt, which is part of the device, is strapped to the midsection or waist of the user, which makes it possible to use the device free from any extraneous connecting points or other fixed supports.

Another object of this invention is to provide an exercising device in which an unlimited number of exercising manipulations may be performed by the self-contained unit attachable to the body of the user and which may be carried by the person and used anywhere indoors or outdoors to provide the proper exercise for the muscles of the body without placing any undue stress on the heart.

Another object is to provide means connectable to the flexible cord whereby the length of the cord is adjustable so that the hand grips and feet stirrups are adjustable to accommodate arms and feet of varying lengths.

DESCRIPTION OF THE PREFERRED EMBODIMENTS

Figures 1, 4, 5:
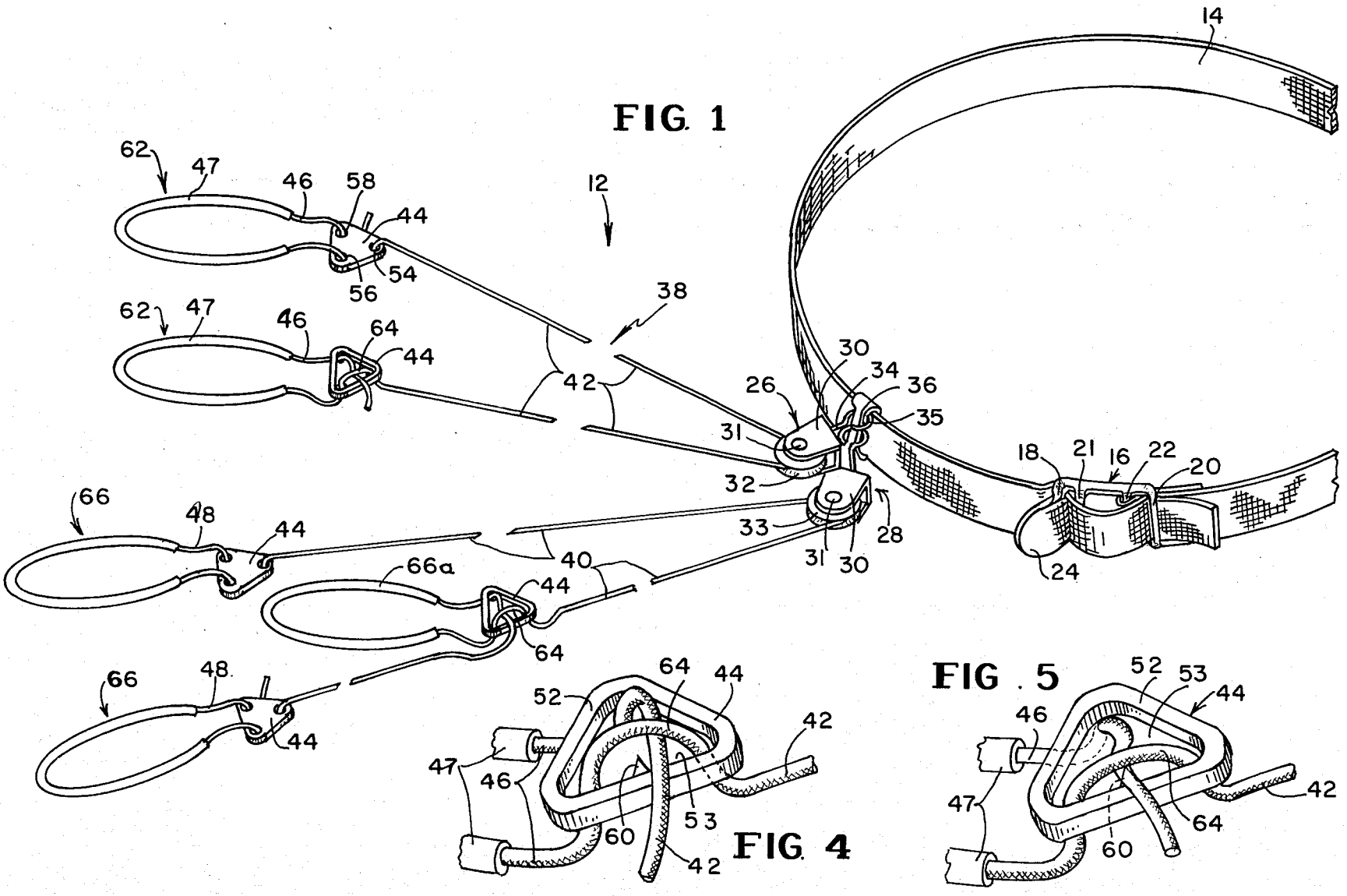
FIG. 1 is a perspective view showing the invention herein.
FIG. 4 is a view showing the cords passing through the connector element of FIGS. 2 and 3, but with the cords unlocked.
FIG. 5 is a view similar to FIG. 4 but with the cords in a locked position relative to the connector member.

The exercising of this invention is generally indicated at 12 and includes a flexible belt generally indicated at 14, with the belt being secured to a buckle generally indicated at 16. The buckle 16 has spaced front and rear ends 18 and 20 and spaced intermediate bars 21 and 22. The rear end of the belt is looped around the intermediate bar 22 and is suitably stitched to the belt so that the buckle is permanently attached to the belt at one end. The opposite or front end of the belt is passed through the opening between the front end 18 of the belt and intermediate bar 21 and then is slipped through inbetween the intermediate bar 22 and end 20 of the buckle to permit the belt to be adjustable relative to the waist or midsection of the user. The buckle has an extension 24 at the front end. The exercising elements, which will be hereinafter described, are secured to the belt so that the exercising device may be used by strapping the belt to the waist of the user and need not be attached to any fixed extraneous object.

Secured to the belt 14 are a pair of pulley elements generally indicated by the numerals 26 and 28. Pulley element 26 has a yoke 30 which supports a pin 31 on which a pulley 32 is rotatably supported. Extending from the opposite end of the yoke is a stem 34 which terminates in a ring 35. The ring is looped around a metal band 36 which, in turn, is anchored to the belt 14, the metal band 36 is such that it can be slid manually if desired with respect to the belt. The other pulley element 28 is similarly constructed and will not be redescribed. It supports a pulley 33. It is similarly secured to the band 36. Each of the pulley elements 26 and 28 is therefore independently secured to the band 36 attached to the belt 14 and they are maneuverable independently of each other.

There are two exercising elements, one generally designated by the numeral 38 and the other by the mumeral 40. The exercising element 38 comprises a flexible cord 42, Preferably of nylon or the like, which passes around the pulley 32 with each of the opposite ends of the cord passing through spaced openings in the triangular-shaped plate generally indicated at 44. The plate 44 is thus connected to the cord and passes outwardly thereof so that a looped portion 46 is formed from said cord. The looped portion 46 is covered by a nylon sleeve 47. The two looped portions 46 and their sleeves 47 are normally engaged by the hands of the user and may be termed the hand grips.

All of the triangular plates 44 are of identical construction whether they be used for forming the hand grips of cord 42 or for forming the loops 48 of the other cord 40 and serve as stirrups for the feet, and hence only one plate will be described in connection with cord 42, but the description of same will suffice for all and will be applicable to cord 40. The triangular plates are best shown in FIGS. 2, 3, 4 and 5. The triangular plate 44 is integrally molded of a plastic material, one side of which is substantially a flat wall surface 50 with a continuously formed raised border 52 extending from the underside thereof so that a recess or well 53 is formed on the underside of said triangular plate. A hole is formed in said triangular plate adjacent each of the three corners, said holes being indicated by the numerals 54, 56 and 58. Extending from the underside is a pointed projection 60 which is adapted to be engaged by the nylon cord when the cord is in a locked position. In FIG. 1, the upper triangular plate 44, which holds the loop for the hand grip, is secured as shown with the flat surface facing upwardly, whereas the other triangular plate is shown inverted for purposes of illustration so that the underside is visible. Normally, both triangular plates would be positioned similar to that of the upper triangular plate. The cord 42, which is used to form the hand grip, is a shorter cord than the other cord 40 which is used to form the leg stirrups. Referring to the cord 42, it is passed around the pulley 32 and one end thereof is passed through the opening 54 in plate 44 from the face side of the plate and into the interior or well portion of the plate and out through the other opening 56 and exteriorly thereof and then looped to form the looped portion 46 previously described, after which the plastic sleeve 47 is put on the free end of the cord. The looped portion 46 and sleeve 47 form a hand grip generally designated by the numeral 62. The free or terminal end of the cord is then inserted into the remaining opening 58 in the triangular plate 44 and is passed under the looped portion 64 of the cord extending within the plate and is passed around the pointed projection with the free or terminal end of the cord extending exteriorly of the plate 44. The free or terminal end of the cord will, when in unlocked position, be as shown in FIG. 4. However, when it is desired to lock the hand grip, the portion of the cord on the underside of the plate 44 is positioned over the pointed projection 60 as in FIG. 5 and the cord is tightened. This locks the triangular plate 44 to the cord and prevents slippage of the cord. The hand grip is thus firmly formed. The opposite end of the cord 42 is similarly secured to the other triangular plate 44. The triangular plate 44 permits the hand grips 62 to be adjusted relative to the cord by increasing or decreasing the free or terminal end of each of said cords after it passes through the plate 44, and thus interlock the hand grips in proper position. In other words, the length of the cord 42 can be shortened from that shown in FIG. 1 by increasing the free ends of the cord passing exteriorly of the plate 44. Once an adjustment is made of the hand grips 62 with respect to the arms of a particular person, this position may be maintained. However, if a person with longer arms or shorter arms uses the exercising device, then the cord can be lengthened or shortened and secured so that the hand grips are positioned in proper relation to the length of the arms of the person.

The cord 40 used for the feet is longer than the cord 42 used for the arms. However, it is similarly connected to the triangular plates 44 and the looped portions of the cords are likewise covered by a vinyl sleeve and said looped portions form the feet stirrups generally indicated at 66 in which the feet of the person are inserted. The adjustments heretofore described with respect to the hand grips is likewise applicable to that of the feet stirrups. Thus, the feet stirrups are adjustable on the cord in the same manner as the hand grips are adjustable. It will be clear that the two hand grips, when engaged by the user's hands, are for exercising the arms, while the feet stirrups are for exercising the legs, each operating independently of the other.

FIG. 1 shows an intermediate foot stirrup indicated at 66a positioned between the opposite end foot stirrups 66. The intermediate foot stirrup **66*a* may be a permanent part of the exercising device so that in the event a person desires to have the principal foot stirrups 66 in properly adjusted position for certain exercises but desires to use a shortened length of the cord 40, the intermediate stirrup 66*a* will be available for immediate use as will be more fully explained in connection with some of the exercises. The intermediate foot stirrup 66*a* is formed similarly to the hand grips 62 and foot stirrups 66 previously described with the use of triangular plate 44. The only difference is that it is formed intermediate the length of the cord 40 with the end of the cord passing out of the plate 44, continuing so that it is connected to the end triangular plate 44 for forming the end foot stirrup 66.** In this manner there are two normally and regularly adjusted foot stirrups with a third shortened foot stirrup available for instant use. This third foot stirrup can likewise be adjusted along the length of the cord.

The entire unit is strapped around the midsection or waist of the body of the person. For example, if a person desires to exercise the arms, the hand grips 62 are engaged by the two hands and the person pulls one hand grip relative to the other to provide the tensioning on the cord between the opposite hands and thereby as one hand pushes outwardly against one hand grip, the other hand is pulled inwardly toward the body and vice versa. Thus, the arms are strengthened by exerting a pull with respect to each other, the cord 42 passing around the pulley 32. The foot stirrups 66 are engaged by the feet and pushing against one stirrup will retract the other in much the same manner as the hand grips with the cord 40 passing around the pulley 33. Pushing against one foot will tension the cord around the pulley and pull upwardly on the opposite foot and so on for strengthening the leg muscles.

Figure 8:
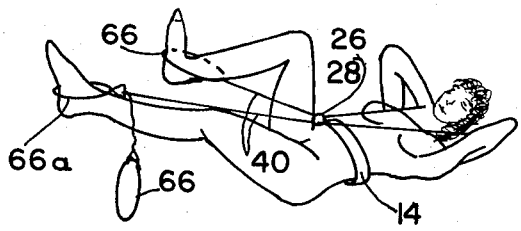
FIG. 8 is another view with a person on a floor surface and showing other exercising positions.

In the event it is desired to use the intermediate foot stirrup which is, for example, as shown in FIG. 8, a person can lie on the floor and use the intermediate foot stirrup **62*a*** with one foot, with the other foot stirrup engaged by the other foot, and thus provide an action simulating that of riding a bicycle.

The various forms of exercise that are possible with this invention are unlimited. However, FIGS. 6–9 show a few of the unlimited possibilities.

Figure 6:
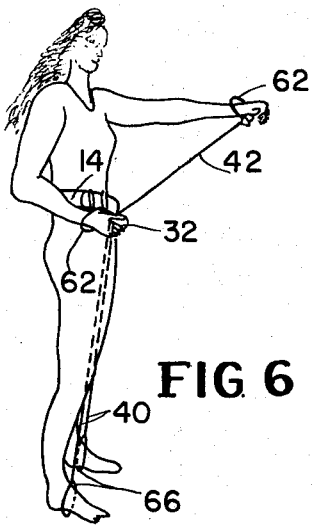
FIG. 6 is a view showing one manner of exercising when a person is in a standing position.

FIG. 6 shows a person standing and exercising or toning up the arms and the waist. In this illustration the opposite hand grips 62 are held by the hands with the cord 42 passing around the pulley 32.

Figure 7:
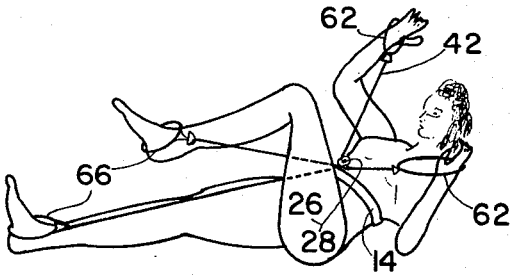
FIG. 7 is a view showing the use of the exercising device with the person in another position, such as resting on a floor surface.

FIG. 7 shows an exercising position in which the person is resting on a horizontal surface and simultaneously exercising the arms and legs. By pushing one leg forwardly on one foot stirrup 66, the cord 40 passes around the pulley 33 to draw the other leg upward. A similar but separate and independent action is imparted to the two arms by operating the two hand grips 62.

FIG. 8 shows a position for simultaneously operating and exercising both the arms and the legs. In this position the intermediate stirrup **66*a* is used which shortens the cord 40 in counterdistinction to that shown in FIG. 7** in which the end stirrups are used for exercising the legs.

Figure 9:
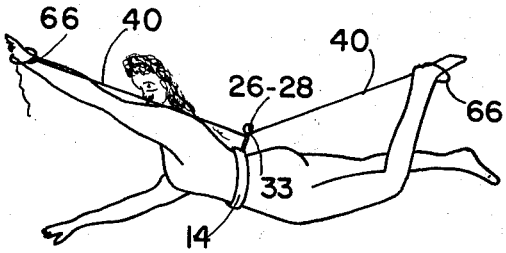
FIG. 9 is a view of a person lying on a floor surface with the front of the body facing downward showing another exercising position.
Figure 2:
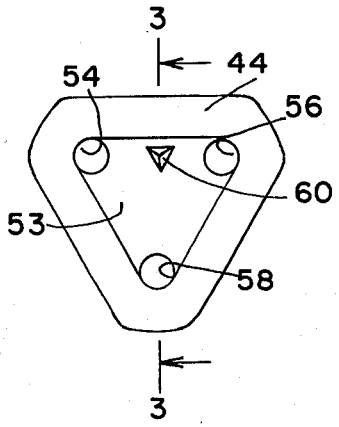
FIG. 2 is a plan view of the triangular connector element.
Figure 3:
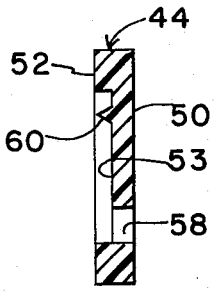
FIG. 3 is a sectional view taken on lines 3—3 of FIG. 2.

FIG. 9 shows another position in which the cord 40, which supports the foot stirrups 66, is used with one of the foot stirrups 66 engaging one foot and the other foot stirrup 66 being engaged by the hand. The cord 40 passes around the pulley 33. This exercises the muscles of the back as well as the arms and legs.

The terms hand grips and foot stirrups are herein used for purposes of illustration and facilitating the description of their normal function. However, in certain exercise the hand grips may be engaged by the feet or one hand and one foot and the same is likewise applicable to the foot stirrups. In the broadest terms the hand grips and foot stirrups are limb engaging members.

In instances where it is desired to reduce the manufacturing costs and still maintain the adjustability of the hand grips and feet stirrups with respect to their respective flexible cords, the following may be done. With respect to the cord 42, one of the triangular plates 44 may be eliminated and that end of the cord may be looped to form a hand grip with the sleeve 47 thereon and the free end of that end of the cord can be secured by a band or other fastening element to the cord 42 to form a permanent loop as one of the hand grips. The opposite end of the cord can be strung through the triangular plate 44 as described. This will permit adjustment of the length of the cord 42 through the use of one of the triangular plates 44 through which the adjustment can be made. The same procedure may be followed with respect to the cord 40 wherein the end feet stirrups 66 are formed. One of such stirrups may be locked in a permanent manner as described with respect to the hand grips, leaving the other end foot stirrup 66 adjustable relative to the cord.

What is claimed is:

1. An exercising device comprising a belt member adapted for securement to the waist or midsection of a person, only one pair of pulley elements secured directly to said belt with each of said pulley elements having a rotatable pulley, said pulleys being connected to the belt at substantially the same location, a first flexible cord engaging the rotatable pulley of one of said pulley elements and means at each of the opposite ends of said first flexible cord for engagement by the limbs of a person, a second flexible cord engaging the rotatable pulley of said other pulley element and means at the opposite ends of said second cord for engagement by the limbs of a person, said first and second cords being tensioned by movement of the person's respective limbs which operate said cords through the medium of each rotatable pulley, said exercising device being operated free of attachment to anything other than the person operating same.

2. An exercising device as set forth in claim 1, in which the first flexible cord has means at the opposite ends forming hand grips for engagement by the hands and the second flexible cord has means at the opposite ends forming foot stirrups for engagement by the feet.

3. An exercising device as set forth in claim 1, in which the opposite ends of the first and second flexible cords are each looped and connected to means on their respective flexible cords to form the limb engaging members.

4. An exercising device as set forth in claim 3 in which the looped portions on the first flexible cord form hand engaging grips and in which the looped portions on the second flexible cord form foot stirrups.

5. An exercising device as set forth in claim 4 in which the hand grips and foot stirrups are adjustable relative to the length of their respective cords.

6. An exercising device as set forth in claim 5 in which the means on the respective flexible cords to which the loops of the cords are connected are plates provided with spaced openings through which the cords pass.

7. An exercising device as set forth in claim 6 in which each of the plates has a projection to which the cord is attached to prevent slippage of the cord.

8. An exercising device as set forth in claim 1, in which the first and second flexible cords are non-elastic and in which the first flexible cord is connected to a member so that the end of the cord is looped to form a hand grip with the free end of said cord being secured to the said member to maintain the loop in a fixed position relative to the length of the flexible cord.

9. A device as set forth in claim 8, in which said member permits the adjustment of the hand loops with respect to each other so that same may be lengthened or shortened relative to said cord.

10. An exercising device as set forth in claim 1, in which the second flexible cord is connected to a member so that the end of the cord is looped to form a foot stirrup with the free end of said cord being secured to said member to maintain the loop in a fixed position relative to the length of the flexible cord and in which said member permits adjustment of the foot stirrups with respect to each other so that same may be lengthened or shortened relative to said cord.

11. An exercising device as set forth in claim 10, in which an intermediate foot stirrup is connected to said second flexible cord.

* * * * *